United States Patent [19]

Sollinger et al.

[11] Patent Number: 4,880,671

[45] Date of Patent: Nov. 14, 1989

[54] METHOD AND APPARATUS FOR COATING RUNNING WEBS

[75] Inventors: Hans-Peter Sollinger; Albrecht Meinecke; Hans Weiss, all of Heidenheim; Rudolf Beisswanger, Steinheim, all of Fed. Rep. of Germany

[73] Assignee: J. M. Voith GmbH, Heidenheim, Fed. Rep. of Germany

[21] Appl. No.: 35,450

[22] Filed: Apr. 7, 1987

Related U.S. Application Data

[63] Continuation of Ser. No. 797,234, Nov. 13, 1985, abandoned.

[30] Foreign Application Priority Data

Nov. 17, 1984 [DE] Fed. Rep. of Germany ..... 3442079
Dec. 21, 1984 [DE] Fed. Rep. of Germany ..... 3446757

[51] Int. Cl.[4] ..... B05D 3/12; B05C 3/12

[52] U.S. Cl. ..... 427/356; 118/407; 118/410; 118/413

[58] Field of Search ..... 118/407, 410, 413; 427/356, 358

[56] References Cited

U.S. PATENT DOCUMENTS

| | | | |
|---|---|---|---|
| 3,079,889 | 3/1963 | Jacobs et al. | 118/8 |
| 3,518,964 | 7/1970 | Nagler | 118/65 |
| 4,250,211 | 2/1981 | Damrau et al. | 427/356 |
| 4,452,833 | 6/1984 | Holt | 118/410 X |
| 4,503,804 | 3/1985 | Damrau | 118/413 X |
| 4,679,524 | 7/1987 | Eklund | 118/413 X |
| 4,791,879 | 12/1988 | Eklund et al. | 118/50 |

FOREIGN PATENT DOCUMENTS

| | | | |
|---|---|---|---|
| 95770 | 2/1973 | Fed. Rep. of Germany | 118/410 |
| 3446525 | 8/1985 | Fed. Rep. of Germany | 118/410 |

*Primary Examiner*—Shrive Beck
*Assistant Examiner*—Alain Bashore
*Attorney, Agent, or Firm*—Lon H. Romanski

[57] ABSTRACT

A coating apparatus, for applying a coating substance to a paper web, has a chamber from which the coating substance is supplied via a slit type mouth communicating with an applicator space which is defined by the paper web and a doctor blade element. At the web, on the side of the applicator space from where the paper web enters, a throttling passage is formed by a back-pressure element in such a manner that a stream of excess coating substance issues from the applicator space via the throttling passage and abruptly separates from the web and in so doing flows away from the web predominantly as a film thereby preventing completely or almost completely the admission of air into the applicator space by the air boundary layer adjacent the moving web.

8 Claims, 1 Drawing Sheet

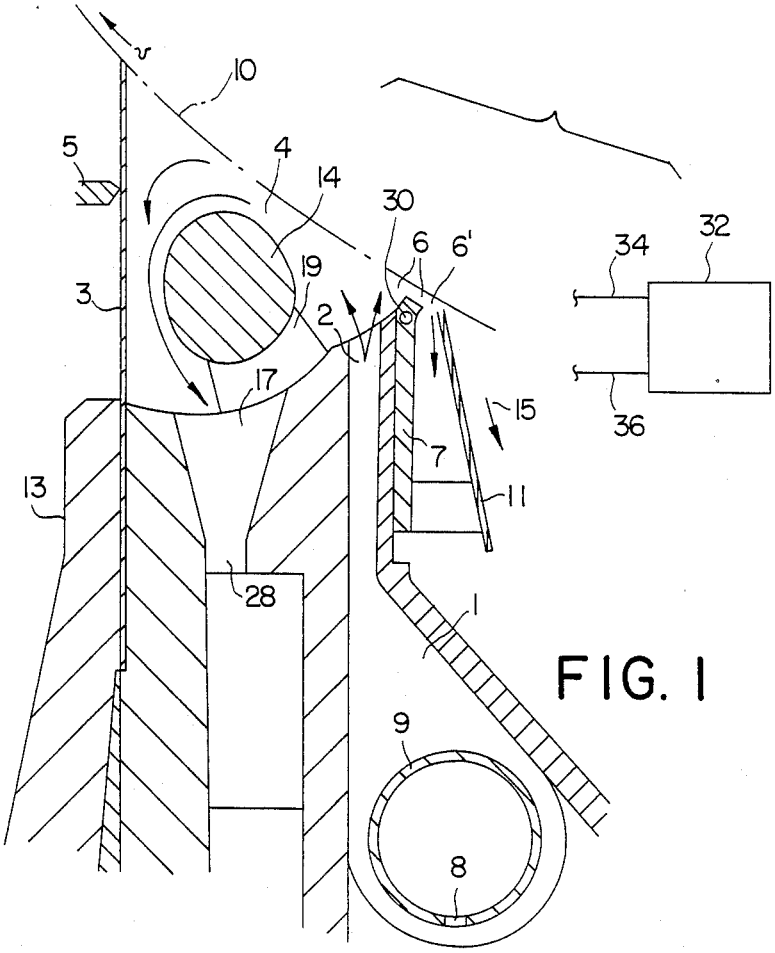
FIG. 1
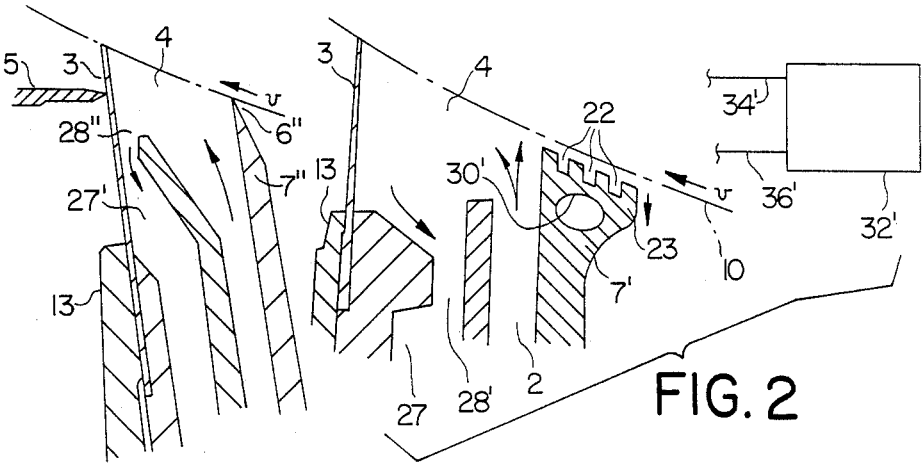
FIG. 2
FIG. 3

METHOD AND APPARATUS FOR COATING RUNNING WEBS

This is a continuation, of application Ser. No. 797,234 filed Nov. 13, 1985 now abandoned.

FIELD OF THE INVENTION

This invention relates generally to apparatus for applying coatings and more particularly to apparatus for applying a coating material to a moving web of paper.

BACKGROUND OF THE INVENTION

It has long been known that paper, made for example on Fourdrinier wire, is significantly enhanced in its characteristics by having such paper coated with a suitable coating material. Such coating of paper, among other things, tends to make both sides of the paper of more uniform quality and enhances its use in subsequent printing processes.

The prior art has heretofore proposed various types of apparatus in an attempt to apply a uniform coating substance to the paper web in a manner whereby streaking and other undesirable characteristics are eliminated. However, none of such prior art devices have proven to be totally acceptable.

For example, U.S. of America Letters Pat. No. 3,079,889 discloses a coating apparatus having a coating applicator space which is defined, on the side where the paper web first enters it, by a slide seal formed with or against the paper web. This, of course, is a distinct disadvantage because at such point, where the slide seal exists, the paper web is still dry and therefore a relatively great friction occurs as between the slide seal and the paper web which, in turn, results in a relatively great danger of the paper web tearing.

In U.S. of America Letters Pat. No. 3,518,964 an attempt was made evidently to solve the problem of paper web tearing (as exists in the structure of said Pat. No. 3,079,899) by applying the coating substance to the paper web through an elongated chamber with a nozzle-like mouth or outlet disposed in juxtaposition to the moving paper web. In such an arrangement, the excess coating substance is scraped-off the paper web by a doctor blade. The structure of said Pat. No. 3,518,964 presents a further problem that being the entrainment of air into the coating substance. As a consequence the entrained air prevents the formation of an at least substantially smooth coating on the paper web.

U.S. of America Letters Pat. No. 4,250,211 discloses a coating apparatus wherein an applicator applies the coating substance to the paper web and a gap is provided generally adjacent the applicator on the side thereof from where the paper web enters. The applicator provides an excess of coating substance and such excess flows through such gap in a direction which is counter to the running direction of the paper web thereby forming a liquid seal which is intended to keep air out of the applicator space to prevent the entrainment of air in the substance coating the paper web. In such apparatus the excess coating substance issuing through said gap is preferably under superatmospheric pressure and of a relatively high rate of flow. However, it has been discovered that such an apparatus still fails to prevent the entrainment of air within the coating material applied to the paper web. This is believed due to the fact that the boundary layer of the air, directly at the paper web, has about the same transport velocity as the paper web itself. This causes the boundary layer of air to have a pressure in the order of about 40.0 mm. water column (400 $N/m^2$), so that such pressure, exhibiting itself as a back-pressure against the liquid seal, enables the air to easily penetrate the liquid seal and become entrained in coating substance being applied to the paper web. It has also been discovered that another disadvantage with apparatus, in accordance with said Pat. No. 4,250,211, is the occurrence of variations in the length and/or width of the paper web actually wetted by the coating substance varies greatly. This is believed due to the use of the liquid seal or blocking stream and the action thereagainst by the said boundary layer of air.

The invention as herein disclosed and described is primarily directed to the solution of the aforestated and other related and attendant problems of the prior art.

SUMMARY OF THE INVENTION

According to the invention, a coating apparatus for applying a coating substance to a moving paper web comprises chamber means, a doctor blade, an application space defined generally by said paper web and said doctor blade, conduit means communicating between said chamber means and said applicator space, said conduit means comprising a slit type discharge mouth opening into said applicator space, throttle means situated at the side of said applicator space where the paper web first enters said applicator space, said throttle means being situated in close juxtaposition to said paper web, said conduit means being effective to receive a coating substance from said chamber means and discharge said coating substance through said slit type discharge mouth into said applicator space for coating said paper web as said paper web travels from said throttle means toward said doctor blade, wherein the quantity of said coating substance discharged into said applicator space is in excess of that required to coat said traveling paper web, and wherein at least a portion of said excess of coating substance flows out of said applicator space and generally between said traveling paper web and said throttle means, said at least a portion of said excess of coating substance thusly flowing out of said applicator space and generally between said traveling paper web and said throttle means abruptly separates from the paper web and flows away from the web in a form predominantly as a film.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views:

FIG. 1 is a transverse cross-sectional view of a coating apparatus employing teachings of the invention;

FIG. 2 is a fragmentary transverse cross-sectional view illustrating a second embodiment of a coating apparatus employing teachings of the invention; and FIG. 3 is a fragmentary transverse cross-sectional view illustrating a third embodiment of a coating apparatus employing teachings of the invention.

DETAILED DESCRIPTION OF THE PREFERRED EMBODIMENT

In the drawings, like reference numbers are employed to identify like or functionally similar parts or elements. However, for ease of disclosure and understanding, especially in FIGS. 2 and 3, some of such reference numbers are provided with a prime or double prime so that specific reference may be made to such without confusion.

Referring now in greater detail to the drawings, FIG. 1 illustrates a coating apparatus comprising an overall housing means with a chamber means 1 into which a pipe or conduit 9 extends. Chamber 1 is preferably of a length (perpendicular to the plane of the drawing) which is substantially equal to the width of the moving paper web 10. A plurality of openings, one of which is shown at 8, formed in the conduit 9 serve to introduce the coating material, from conduit 9, as evenly as possible into and along the length of chamber 1. Conduit 9 receives fresh coating substance at a superatmospheric pressure from an associated source (not shown).

A doctor blade 3, rigidly held by the overall housing means, serves to scrape the excess applied coating substance from the moving paper web 10 as said paper web 10 moves in the direction of arrow, v, past the doctor blade 3 which also functions as a coating blade. The coating or doctor blade 3 is preferably held in assembled relationship to the overall housing means as by a pressure or clamping plate 13 suitably secured to the remaining portion of the overall housing means.

As should be evident, in the embodiment of FIG. 1 an applicator space 4 which extends (in a direction perpendicular to the plane of the drawing) for the full width of the paper web 10 and which is provided with end sealing means as at a location along or outboard the sides of the paper web (as is generally well known in the art) is defined generally by the blade element 3 and the paper web 10 which is held as against a cooperating rotating drum. As viewed in FIG. 1 such applicator space exists generally above the overall housing means.

As can be seen in FIG. 1, the coating substance flows out of the slit-like discharge mouth 2 and into the applicator space 4 with the flow of such coating substance being generally depicted by the arrows in applicator space 4 and extending from the discharge mouth 2. In the preferred embodiment, the length of mouth 2 (in a direction perpendicular to the plane of the drawing) is such as to extend for the full width of the moving paper web 10. Further, in the preferred embodiment, a guide or deflector member 14, which preferably extends for the full length of applicator space 4 and is supported as by a plurality of support means one of which is shown at 19, serves to positively guide the coating substance in the direction of the arrows and aids in getting such coating substance to flow against the edge of coating blade 3 at the area where such blade 3 abuts against the moving paper web 10. It should also be pointed out that the coating blade 3 can be flexed as by moving a pressure strip member 5, against blade 3, as in a direction to the right as viewed in FIG. 1. Also, the coating blade 3 can be similarly flexed by rotation of the overall housing means; such flexing of the blade 3 by either method results in having the abutting edge of the blade 3 press more strongly against the running paper web 10.

The applicator space 4 is also placed in communication with drain passage means 17 which, in the preferred embodiment comprises throttling or restriction means 28. Such drain passage means 17 serves to remove, from applicator space 4, any excess coating substance along with any included air, as may have been entrained from chamber 1, and deliver such to a suitable receiving vat or the like (not shown). Such drain passage means 17 provides a highly desirable function because it has been discovered that the excess coating substance scraped off the moving paper web 10, by the blade 3, may stay in the applicator space in a turbulent flow for a prolonged period of time and such if permitted to again enter into the coating operation, without first undergoing a re-processing, causes streakiness of the coating because the scraped-off coating substance has an altered consistency. Accordingly, the drain passage means 17 permits the scraped-off excess coating material to be removed from applicator chamber 4 and thereby assuring that only a fresh coating substance will be employed for the coating operation. The excess scraped-off coating thusly removed by drain means 17 may, of course, undergo reprocessing.

Still with reference to FIG. 1, an adjustably positionable extension or back-pressure means 7 is situated as along a front wall of the overall housing means and extends as for the full width of the paper web 10. The upper (as viewed in FIG. 1) end of the back-pressure means 7 is brought into close proximity to the paper web 10 as to preferably define therebetween a throttling-like duct or space 6. Such throttling means permits only a relatively small amount of coating substance from applicator space 4 to flow through the throttling space 6. Spaced forwardly or ahead of the throttling duct 6 is another throttle space 6′ which is formed as between the upper edge of a barrier wall 11 and the paper web 10. In the preferred embodiment, the upper edge of barrier wall 11, and therefore the throttling duct 6′, extend for the full width of the paper web 10.

OPERATION OF THE INVENTION

Referring to FIG. 1, a coating substance, under superatmospheric pressure, is delivered to chamber means via conduit 9 and passages 8 and is forced upwardly from chamber 1 as to be discharged from slit-like discharge mouth 2 into the applicator space 4 and generally toward the moving paper web 10. The flow of coating substance is generally counter-clockwise (as viewed in FIG. 1) about the guide or deflector means 9 with a portion of such coating substance being directed generally toward the throttling means 6. The guide means 14 encourages the flow of the coating substance against the blade member 3 and, in particular to that area of the blade 3 which abuts against the moving paper web 10. The excess coating material scraped from the paper web 10, as by coating blade 3, is in effect driven downwardly by the flow pattern of the coating material and is removed to a point outside of the applicator space 4 by drain conduit means 17.

A portion of the pressurized coating material delivered via discharge mouth 2 is, as stated, directed toward the throttling means 6. It should be remembered that such coating material is for all practical purposes at least substantially free of entrained air and since it is discharged into applicator space 4 at an area in close proximity to throttling means 6, such coating material does not mix with any of the scraped-off coating material before it, under superatmospheric pressure starts to flow through the throttling means or duct 6. In the preferred embodiment, the distance between the top of back-pressure means 7 and the running paper web 10 is in the order of 0.5 mm to 3.0 mm. The flow of such coating substance flowing through the throttling duct 6 of course forms a liquid seal as between the counter-moving paper web 10 and the top of back-pressure means 7. As the coating substance flows through the throttling duct 6 a major portion thereof flows downwardly through the space between throttling means 6 and 6' and flows to an appropriate outside receptacle such as a vat or the like (not shown). The passage of such coating substance through throttling means 6, of course, causes a pressure drop in the coating substance which has thusly flowed through throttling means 6; however, the positive pressure of the remaining portion of the coating substance which has not flowed downwardly and outwardly (between throttling means 6 and 6') is still sufficient to cause it to flow through the second throttling means 6' which is of a comparatively small gap. Such remaining portion of the coating substance flows through the second throttling means 6' and immediately upon completing such passage abruptly detaches from the paper web 10 and, because of its inherent adhesion and cohesion forces, runs as a thin film along the barrier wall 11 away from the paper web 10 and toward an associated receiving vat (not shown).

In practice it has been found that best results are obtained if the opening of the throttling means 6 in combination with the opening of the throttling means 6' are such that the pressure of the coating substance, as it exists in the applicator space 4, is reduced to such an extent that there exists barely or little more pressure (on the coating substance as it exits the throttling means 6') than the back-pressure of the air boundary layer entrained by the paper web 10 at the exit side of the throttling means 6'. The pressure of such remaining portion of the coating substance may of course still be slightly greater because of the adhesion forces; this, in turn, means that the coating substance separates as a thin film (at the exist side of the throttling means 6') from the paper web 10 at an angle which corresponds to the arrow 15 indicating the runoff direction. In practice, such a thin film constitutes a liquid back-pressure wall (in the region of the throttling means 6') for the entrained air boundary layer so that no or almost no air can be entrained by the web and taken along into the applicator space 4.

Further, as a consequence of the throttling means 6 and 6' and the fluid seal formed therein by the coating substance flowing therethrough (as hereinbefore explained), the wetting length of the paper web 10 by the coating substance is always substantially constant. Also, at the area close to the throttling means and at the starting end of the applicator space 4 only fresh coating substance gets to the paper web 10 and such coating substance continues to be supplied to such area as a coating in a quantity which is considerably greater than the desired application weight, with the excess being subsequently scraped off by blade 3 together with any coating substance which may have become no longer fresh.

As should now be apparent, an important feature is that by providing the drain passage means 17 and the restriction or throttling means 28, impurities and any air are continually removed with the excess coating substance from the applicator space 4 without substantially interfering with the newly inflowing coating substance from discharge mouth 2 which thereby alone and first forms the boundary layer at the paper web 10 and therefore alone contributes to the coating of the web 10.

It may not be necessary, in the practice of the invention, to have the applictor space and coating substance therein under a superatmospheric pressure if, for example, as depicted in FIG. 1 the coating substance supplied by discharge mouth 2 is delivered or directed toward the throttling means 6 at a speed sufficiently great so that such speed itself creates a sufficient back-pressure of or in the coating substance flowing through the throttling means 6. This, in turn, simplifies the apparatus inasmuch as the lateral or end seals of the applicator space 4, at both ends, would be less costly to construct and maintain.

Referring in greater detail to FIG. 2, the back-pressure element or means 7' is illustrated as comprising at its upper end 23 a plurality of longitudinally extending spaced grooves or recesses 22 forming a labyrinth-like throttling means in conjunction with the juxtaposed moving paper web 10. In the embodiment of FIG. 2 the labyrinth throttling means presents a sufficient restriction to the flow therethrough of said fresh coating substance (supplied via discharge mouth 2) as to result in only an overflow film of coating substance flowing out via the labyrinth throttling means and downwardly along the forward wall of the back-pressure element as indicated generally by the downwardly directed arrow in the vicinity of reference number 23 of FIG. 2.

The coating substance is, as in FIG. 1, still directed into applicator space 4 upwardly against the moving paper web 10 and towards the doctor blade means 3 in the area where the blade 3 abuts against the paper web 10. The coating substance thusly delivered via discharge mouth 2 flows in a generally counter-clockwise direction, as viewed in FIG. 2, and then the excess coating substance along with the scraped-off excess coating material are directed to the drain conduit means 27 which also preferably comprises throttling or flow restriction means 28' functionally equivalent to the drain conduit means 17 and restriction means 28 of FIG. 1.

Similar to FIG. 1, an important feature of the embodiment of FIG. 2 is that by providing the drain passage means 27 and the restriction or throttling means 28' impurities and any air are continually removed with the excess coating substance from the applicator space 4 without substantially interfering with the newly inflowing coating substance from discharge mouth 2 which thereby alone and first forms the boundary layer at the paper web 10 and therefore along contributes to the coating of the web 10.

Further, it is contemplated that, for example, suitable passages and or conduit means may be formed in the back-pressure means 7' and that either a liquid or gaseous heat transfer medium would then be made to flow therethrough in order to thereby either cool or heat the back-pressure means 7' and/or 7 in order to keep the coating substance highly fluid and/or to prevent caking of such coating substance on the associated draining surface so that in any event the film of coating substance passing out of the throttling means can easily run down along the drain surface of the back-pressure element 7 and/or 7'.

More particularly, with reference to FIG. 1, a suitable source 32 of heat transfer medium is depicted as having supply conduit or passage means 34 in operative communication with conduit or passage means 30, formed as in the back-pressure means 7, for supplying the heat transfer medium to the passage means 30, and return conduit or passage means 36 also in operative communication with such conduit or passage means 30 for the return of the heat transfer medium from passage means 30 to the source 32. Similarly, and with respect to FIG. 2, a suitable source 32' of heat transfer medium is depicted as having supply conduit or passage means 34' in operative communication with conduit or passage means 30', formed as in the back-pressure means 7', for supplying the heat transfer medium to the passage means 30', and return conduit or passage means 36' also in operative communication with such conduit or passage means 30' for the return of the heat transfer medium from passage means 30' to the source 32'.

Referring in greater detail to FIG. 3, the back-pressure element 7'' is illustrated as having a narrow or knife-edge-like upper end which is closely spaced to the paper web 10 and such, in conjunction with the paper web 10 forms a throttling means 6''. The length of such narrow or knife-edge-like upper end (in a direction perpendicular to the plane of the drawing) extends for the full width of the paper web 10. In the embodiment of FIG. 3, the throttling means 6'' presents a sufficient restriction to the flow therethrough of said coating substance (supplied via discharge mouth 2) as to result in only an overflow film of coating substance flowing out of the throttling means and downwardly along the forward wall of the back-pressure element 7''.

As in FIGS. 1 and 2, the coating substance is still directed into the applicator space 4 upwardly against the moving paper web 10 and towards the doctor blade means 3 in the area where the blade 3 abuts against the paper web 10. The coating substance thusly delivered via discharge mouth 2 flows in a generally counterclockwise direction, as viewed in FIG. 3, and then the excess coating substance along with the scraped-off excess coating material are directed to the drain conduit means 27' which also preferably comprises throttling or flow restriction means 28'' functionally equivalent to the drain conduit means 17 and restriction 28 of FIG. 1 and functionally equivalent to the drain conduit means 27 and flow restriction means 28' of FIG. 2. However, it will be noted that in the embodiment of FIG. 3, the drain passage means 27' is partly defined by the coating or doctor blade means 3.

Similar to FIGS. 1 and 2, an important feature of the embodiment of FIG. 3 is that by providing the drain passage means 27' and the restriction or throttling means 28'' impurities and any air are continually removed with the excess coating substance from the applicator space 4 without substantially interfering with the newly inflowing coating substance from discharge mouth which thereby alone and first forms the boundary layer at the paper web 10 and therefore alone contributes to the coating of the web 10. As in the embodiment of FIG. 2, so too in the embodiment of FIG. 3, except for a small portion of the coating substance serving as a barrier and flowing through the throttling means 6'', almost the entire excess amount of coating material with the entrained or included air and the impurities flow out through the drain passage means 27' (27 in FIG. 2).

Generally, it has been found that the ratio of the quantity of the coating material employed for causing a barrier seal (as at the respective various throttling means 6, 6'', 22 and 6'') to the quantity of the excess coating material exiting via the respective drain conduit means is in the order of 1:5.

The embodiment of FIG. 3 is best suited for use in those situations where regulation of the force or tension of the coating blade 3 is accomplished by appropriate rotation of the entire apparatus about an axis which is at least close to the line of abutment between the pressure strip 5 and blade 3.

In the preferred embodiments, of all three disclosed embodiments, it is highly preferred that the discharged mouth 2 and the discharge or drain conduit means 17, 27 and 27' are provided in a rigid structural part in which or to which the doctor blade 3 is also mounted so as to thereby eliminate possible variations of the flow cross-sections due to the undesired shifting of individual components.

It is also contemplated that the top end of the member 11 of FIG. 1 could have a sharp configuration as at the top of back-pressure element 7'' depicted in FIG. 3.

In the preferred embodiments, the drain passage or conduit means 17, 27 and 27' are of a width (as measured in a direction perpendicular to the planes of the respective drawings) which extends for the full width of the paper web 10 and, further, in each of said drain conduit means the respective flow restriction means 28, 28' and 28'' are located at least near the end of the drain conduit means where such end opens into the applicator space.

Further, as already should be evident, in each of the embodiments, and in the preferred form thereof, the discharge mouth 2 is situated relatively close to the back-pressure elements, as compared to its location with respect to the doctor blade 3 so that the fresh coating substance is discharged first into the area of the throttling means 6, 6', 22 and 6'' as well as against the paper web 10 as it first enters into the applicator area. Also, in at least the embodiments of FIGS. 1 and 2, the areas at which drain conduit means 17 and 27 communicate with the applicator space 4 are each spaced a substantial distance away from the doctor blade means 3.

It has also been discovered that excellent results are obtained when the throttling means 6, 6' are so adjusted so that the volume of the stream of coating substance flowing therethrough is at most one-third of that which flows out of the drain conduit means 17. The same applies to the labyrinth throttling means 22 and drain conduit means of FIG. 2.

Further, in the preferred form of at least the embodiment of FIG. 1, the drain surface 11 of the back-pressure element 7 extends in a direction away from the paper web forms an angle of at least 25° with respect to the web 10. This angle may be measured as by the imaginary extension of the drain surface 11 to intersect the paper web 10 and, at such intersection, forming a plane tangent thereto. The angle of at least 25° would then exist as between the tangent plane and the drain surface 11 adjacent thereto. It has been discovered that an angle of at least 25° results in a sharp separation of transferred coating substance as a film from the web 10.

It has also been discovered that enhanced results are obtained if the discharge mouth 2 opens into the applicator space 4 at a location which is at least 1.0 cm. closer to the web 10 than where the inlet opening of the drain passage means 17 and/or 27 is located in the applicator space 4.

Although only a preferred embodiment and selected modifications of the invention have been disclosed and described, it is apparent that other embodiments and modifications of the invention are possible within the scope of the appended claims.

What is claimed is:

1. An arrangement for applying a coating substance to a moving paper web, comprising chamber means for receiving said coating substance, a doctor blade, an applicator space defined generally by said paper web and said doctor blade, conduit means communicating between said chamber means and said applicator space, said conduit means comprising a slit type discharge mouth opening into said applicator space, throttle means situated at the side of said applicator space where said paper web first enters said applicator space, wherein said applicator space extends for the full distance between said throttle means and said doctor blade, said throttle means being situated in close juxtaposition to said paper web as to define a throttling path between said throttle means and said paper web, said conduit means being effective to receive said coating substance from said chamber means and to discharge said coating substance through said slit type discharge mouth into said applicator space for coating said paper web as said paper web travels from said throttle means toward said doctor blade, wherein the quantity of said coating substance discharged into said applicator space is in excess of that required to coat said traveling paper web, drain means communicating directly with a lower portion of said applicator space for draining from said lower portion of said applicator space a major portion of said excess of coating substance thereby removing said major portion of said excess of coating substance from said applicator space before said major portion of said excess of coating substance has a chance to form and become a flowing seal against and between said paper web and any associated structure spaced from and in juxtaposition to said paper web, wherein said throttling path permits a minor portion of said excess of coating substance to flow out of said applicator space and generally through said throttling path thereby forming a flowing seal as between said paper web and said throttle means, wherein said throttle means comprises labyrinth-like grooved surface means spaced from and juxtaposed to said paper web, and wherein the space between said paper web and said labyrinth-like grooved surface means comprises said throttling path.

2. An arrangement according to claim 1 wherein said labyrinth-like grooved surface means is spaced a maximum distance of 3.0 mm. from said paper web.

3. An arrangement for applying a coating substance to a moving paper web, comprising chamber means for receiving said coating substance, a doctor blade, an applicator space defined generally by said paper web and said doctor blade, conduit means communicating between said chamber means and said applicator space, said conduit means comprising a slit type discharge mouth opening into said applicator space, throttle means situated at the side of said applicator space where said paper web first enters said applicator space, wherein said applicator space extends for the full distance between said throttle means and said doctor blade, said throttle means being situated in close juxtaposition to said paper web as to define a throttling path between said throttle means and said paper web, said conduit means being effective to receive said coating substance from said chamber means and to discharge said coating substance through said slit type discharge mouth into said applicator space for coating said paper web as said paper web travels from said throttle means toward said doctor blade, wherein the quantity of said coating substance discharge into said applicator space is in excess of that required to coat said traveling paper web, drain means communicating directing with a lower portion of said applicator space for draining from said lower portion of said applicator space a major portion of said excess of coating substance thereby removing said major portion of said excess of coating substance from said applicator space before said major portion of said excess of coating substance has a chance to form and become a flowing seal against and between said paper web and any associated structure spaced from and in juxtaposition to said paper web, wherein said throttling path permits a minor portion of said excess of coating substance to flow out of said applicator space and generally through said throttling path thereby forming a flowing seal as between said paper web and said throttle means, wherein said throttle means comprises first throttle means and second throttle means, drain passage means formed generally between said first throttle means and said second throttle means, said drain passage means comprising a drain passage means inlet opening toward spaced from and juxtaposed to said paper web as to thereby convey in a direction away from said paper web at least a large part of said minor portion of said excess of said coating substance as flows in said throttling path from said first throttle means and toward said second throttle means, wherein each of said first and second throttle means extend for the full width of said paper web and are spaced from each other, wherein each of said first and second throttle means are spaced from and juxtaposed to said paper web, wherein said first throttle means is situated as to be next adjacent said applicator space, and wherein said second throttle means is situated as to be outwardly of said first throttle means thereby causing said paper web to first traverse said second throttle means and then said drain passage means inlet and only thereafter traverse said first throttle means and enter said applicator space.

4. An arrangement according to claim 3 wherein said first throttle means comprises a labyrinth-like grooved surface means spaced from and juxtaposed to said paper web.

5. An arrangement for applying a coating substance to a moving paper web, comprising chamber means for receiving said coating substance, a doctor blade, an applicator space defined generally by said paper web and said doctor blade, conduit means communicating between said chamber means and said applicator space, said conduit means comprising a slit type discharge mouth opening into said applicator space, throttle means situated at the side of said applicator space where said paper web first enters said applicator space, wherein said applicator space extends for the full distance between said throttle means and said doctor blade, said throttle means being situated in close juxtaposition of said paper web as to define a throttling path between said throttle means and said paper web, said conduit means being effective to receive said coating substance from said chamber means and to discharge said coating substance through said slit type discharge mouth into said applicator space for coating said paper web as said paper web travels from said throttle means toward said doctor blade, wherein the quantity of said coating substance discharged into said applicator space is in excess of that required to coat said traveling paper web, drain means communicating directly with a lower portion of said applicator space for draining from said lower portion of said applicator space a major portion of said excess of coating substance thereby removing said major portion of said excess of coating substance from said applicator space before said major portion of said excess of coating substance has a chance to form and become a flowing seal against and between said paper web and any associated structure spaced from and in juxtaposition to said paper web, wherein said throttling path permits a minor portion of said excess of coating substance to flow out of said applicator space and generally through said throttling path thereby forming a flowing seal as between said paper web and said throttle means, and wherein said throttle means comprises heat-transfer passage means for receiving therein a fluid heat transfer medium.

6. An arrangement for applying a coating substance to a moving paper web, comprising chamber means for receiving said coating substance, a doctor blade, an applicator space defined generally by said paper web and said doctor blade, conduit means communicating between said chamber means and said applicator space, said conduit means comprising a slit type discharge mouth opening into said applicator space, throttle means situated at the side of said applicator space where said paper web first enters said applicator space, wherein said applicator space extends for the full distance between said throttle means and said doctor blade, said throttle means being situated in close juxtaposition to said paper web as to define a throttling path between said throttle means and said paper web, said conduit means being effective to receive said coating substance from said chamber means and to discharge said coating substance through said slit type discharge mouth into said applicator space for coating said paper web as said paper web travels from said throttle means toward said doctor blade, wherein the quantity of said coating substance discharged into said applicator space is in excess of that required to coat said traveling paper web, drain means communicating directly with a lower portion of said applicator space for draining from said lower portion of said applicator space a major portion of said excess of coating substance thereby removing said major portion of said excess of coating substance from said applicator space before said major portion of said excess of coating substance has a chance to form and become a flowing seal against and between said paper web and any associated structure spaced from and in juxtaposition to said paper web, wherein said throttling path permits a minor portion of said excess of coating substance to flow out of said applicator space and generally through said throttling path thereby forming a flowing seal as between said paper web and said throttle means, wherein both said discharge mouth and said drain means communicate with said applicator space at locations which are remote from said doctor blade and between said doctor blade and said throttle means, and further comprising flow guide means situated in said applicator space, said flow guide means extending for generally the full width of said paper web, said flow guide means being effective to direct at least a substantial portion of said coating substance as is delivered by said discharge mouth to flow against both said paper web passing through said applicator space and said doctor blade and only thereafter permitting flow of directed coating substance toward said drain means.

7. A process for applying a coating substance to a moving paper web by chamber means receiving said coating substance and an applicator space defined generally at said paper web by a throttling means and a doctor blade, said coating substance being received by conduit means from said chamber means in order to discharge said coating substance into said applicator space at the side of said applicator space where said paper web first enters said applicator space for coating said paper web as said paper web travels from said throttle means toward said doctor blade, wherein the quantity of said coating substance discharged into said applicator space is in excess of that required to coat said traveling paper web, draining by drain means a major portion of said excess of coating substance from said applicator space, wherein throttling at the side of said applicator space where said paper web first enters said applicator space by said throttle means situated in close juxtaposition to said paper web as to define a throttling path between said throttle means and said paper web to sufficiently restrict the flow therethrough to a minor portion of said excess of coating substance to a volume rate of flow which at a maximum is one-third of the volume rate of flow of said major portion flowing through said drain means whereby such of said minor portion of said excess coating substance as flows through and exits said throttling path exits in the form of a film abruptly separating from said paper web and flowing downwardly along said throttle means.

8. A process for applying a coating substance to a moving paper web according to claim 7 wherein said film abruptly separating from said paper web is directed in a direction of flow which is at an angle of at least 25° with respect to a tangent of said paper web with said tangent existing at where said direction of flow if extended toward said paper web would intersect said paper web.

* * * * *